US007654071B2

(12) United States Patent
Yoshimoto et al.

(10) Patent No.: US 7,654,071 B2
(45) Date of Patent: Feb. 2, 2010

(54) COMPOSITE FIBERS

(75) Inventors: Masato Yoshimoto, Matsuyama (JP); Shigeru Morioka, Matsuyama (JP); Satoshi Yasui, Osaka (JP)

(73) Assignee: Teijin Fibers Limited, Osaka (JP)

( * ) Notice: Subject to any disclaimer, the term of this patent is extended or adjusted under 35 U.S.C. 154(b) by 349 days.

(21) Appl. No.: 11/658,575

(22) PCT Filed: Sep. 2, 2005

(86) PCT No.: PCT/JP2005/016567

§ 371 (c)(1),
(2), (4) Date: Jan. 26, 2007

(87) PCT Pub. No.: WO2006/025610

PCT Pub. Date: Mar. 9, 2006

(65) Prior Publication Data

US 2009/0004469 A1 Jan. 1, 2009

(30) Foreign Application Priority Data

Sep. 3, 2004 (JP) ..... 2004-256628

(51) Int. Cl.
*D02G 3/02* (2006.01)

(52) U.S. Cl. ..... 57/243; 57/244; 57/246

(58) Field of Classification Search ..... 57/243–247
See application file for complete search history.

(56) References Cited

U.S. PATENT DOCUMENTS

| | | | | |
|---|---|---|---|---|
| 5,307,614 | A * | 5/1994 | Nabeshima et al. | 57/207 |
| 5,688,594 | A * | 11/1997 | Lichscheidt et al. | 428/370 |
| 2009/0029164 | A1 * | 1/2009 | Yoshimoto et al. | 428/370 |

FOREIGN PATENT DOCUMENTS

| | | | |
|---|---|---|---|
| EP | 0 413 280 | A2 | 2/1991 |
| FR | 1 315 515 | A | 1/1963 |
| GB | 1 444 319 | A | 7/1976 |
| JP | 59-199816 | A | 11/1984 |
| JP | 61-266616 | A | 11/1986 |
| JP | 3-213518 | A | 9/1991 |
| JP | 2003-239141 | A | 8/2003 |
| JP | 2004-360094 | A | 12/2004 |

* cited by examiner

*Primary Examiner*—Shaun R Hurley
(74) *Attorney, Agent, or Firm*—Sughrue Mion, PLLC

(57) ABSTRACT

A composite fiber is described which comprises a polyester component and a polyamide component bound in a side-by-side or eccentric core-in-sheath structure, exhibiting a percentage of crimp DC of 1.3-15.0% after the composite fiber is treated in boiling water for 30 minutes under a load of $1.76\times10^{-3}$ cN/dtex, and then dry heat treated for 30 minutes at 100° C. under a load of $1.76\times10^{-3}$ cN/dtex, for stabilization of the crimps and further dry heat treated for one minute at 160° C. under a load of $1.76\times10^{-3}$ cN/dtex, as well as a percentage of crimp HC of 0.5-10% after immersion in water at 20-30° C. for 10 hours, and a difference ΔC of 0.5-7.0% between the percentage of crimps.

10 Claims, No Drawings

COMPOSITE FIBERS

FIELD OF THE INVENTION

The present invention relates to composite fibers having a crimping property whereby humidity produces significant variation in the percentage of crimp in a reversible manner. More specifically, the invention relates to composite fibers which can be used to produce fabrics which maintain and exhibit excellent percentage of crimp variation properties even after the processes of dyeing and finishing.

BACKGROUND ART

It is well known in the prior art that natural fibers of cotton, wool and feathers can undergo reversible variation in form and percentage of crimp in response to changes in humidity. It has long been attempted to impart such function to synthetic fibers, and for example, Patent documents 1 and 2 have proposed forming side-by-side composite fibers using nylon-6 and polyethylene terephthalate. However, these composite fibers have not been actually employed because of the minimal reversible variation in the percentage of crimp in response to changes in humidity.

Patent documents 3 and 4 later proposed improvements in the heat treatment conditions. Also, Patent documents 5-8 proposed applications of this prior art. However, a practical level of use has not been achieved because of the small degree of variation in percentage of crimp which results after steps such as dyeing and finishing.

On the other hand, Patent document 9 attempts to overcome the problem described above by forming a polyester component and a polyamide component into a flat form and bonding them, in a side-by-side fashion, using a highly hygroscopic polyamide such as nylon-4 as the polyamide component but, because of the poor reeling stability of nylon-4 and reduced crimping performance resulting from heat treatment, there has been a limit to the practicality of even this type of composite fiber.

[Patent document 1] Japanese Examined Patent Publication SHO No. 45-28728

[Patent document 2] Japanese Examined Patent Publication SHO No. 46-847

[Patent document 3] Japanese Unexamined Patent Publication SHO No. 58-46118

[Patent document 4] Japanese Unexamined Patent Publication SHO No. 58-46119

[Patent document 5] Japanese Unexamined Patent Publication SHO No. 61-19816

[Patent document 6] Japanese Unexamined Patent Publication No. 2003-82543

[Patent document 7] Japanese Unexamined Patent Publication No. 2003-41444

[Patent document 8] Japanese Unexamined Patent Publication No. 2003-41462

[Patent document 9] Japanese Unexamined Patent Publication HEI No. 3-213518

SUMMARY OF THE INVENTION

Problems to be Solved by the Invention

The present invention has been accomplished in light of the circumstances of the prior art, and its object is to provide composite fibers having a crimping property whereby humidity produces significant variation in the percentage of crimp in a reversible manner, which can maintain the aforementioned excellent percentage of crimp variation property even through the processes of dyeing and finishing, and which are therefore highly practical and suitable for composing comfortable fabrics with reduced stuffy feeling.

Means for Solving the Problems

The composite fibers of the invention are composite fibers comprising a polyester component and a polyamide component bound in a side-by-side or eccentric core-in-sheath structure, which composite fiber exhibits a percentage of crimp DC of 1.3-15.0% after the composite fibers are treated in boiling water for 30 minutes under a load of $1.76\times10^{-3}$ cN/dtex, and then dry heat treated for 30 minutes at 100° C. under a load of $1.76\times10^{-3}$ cN/dtex for stabilization of the crimps and further dry heat treated for one minute at 160° C. under a load of $1.76\times10^{-3}$ cN/dtex, a percentage of crimp HC of 0.5-10% after the crimped composite fibers are immersed in water at 20-30° C. for 10 hours, and a difference ΔC between the percentage of crimps DC and HC of 0.5-7.0%, as defined by the following equation:

$$\Delta C(\%)=DC(\%)-HC(\%).$$

The polyester component in the composite fibers of the invention is preferably a modified polyester having an intrinsic viscosity (IV) of 0.30-0.43 and comprises 5-sodiumsulfoisophthalic acid copolymerized in an amount of 2.0-4.5 molar % based on the acid component.

The tensile stress of a composite fiber of the invention under 10% elongation of the composite fiber is preferably 1.6-3.5 cN/dtex.

The tensile strength of a composite fiber of the invention is preferably a tensile strength of 3.0-4.7 cN/dtex.

A combined filament yarn (1) according to the invention comprises the composite fiber according to claim 1 and a different type of fiber with a smaller boiling water shrinkage.

A combined filament yarn (2) according to the invention comprises the composite fiber according to claim 1 and a different type of fiber with a larger boiling water shrinkage.

A false twisted yarn according to the invention is obtained by supplying a composite fiber comprising a polyester component and a polyamide component bound in a side-by-side or eccentric core-in-sheath structure to a false twisting step, wherein the fibers in the false twisted yarn exhibit after the false twisted yarn is treated in boiling water for 30 minutes under a load of $1.76\times10^{-3}$ cN/dtex, and then dry heat treated for 30 minutes at 100° C. under a load of $1.76\times10^{-3}$ cN/dtex for stabilization of the crimps and further dry heat treated for one minute at 160° C. under a load of $1.76\times10^{-3}$ cN/dtex, a percentage of crimp TDC of 10-30%, the fibers in the resultant crimped false twisted yarn exhibit, a percentage of crimp THC of 5-17%, a after the crimped false twisted yarn is immersed in water at 20-30° C. for 10 hours, a percentage of crimp THC of 5-17%, and the difference in percentage of crimp ΔTC represented by (TDC(%)−THC(%)) is 3-15%.

The composite fibers supplied to the false twisting step for the false twisted yarn of the invention preferably exhibit after the composite fibers are treated in boiling water for 30 minutes under a load of $1.76\times10^{-3}$ cN/dtex, and then dry heat treated for 30 minutes at 100° C. under a load of $1.76\times10^{-3}$ cN/dtex for stabilization of the crimps and further dry heat treated for one minute at 160° C. under a load of $1.76\times10^{-3}$ cN/dtex, a percentage of crimp DC of 1.3-15.0%, and after the crimped composite fibers are immersed in water at 20-30° C. for 10 hours, a percentage of crimp HC of 0.5-10%, and a difference ΔC between the percentage of crimps DC and HC of 0.5-7.0%.

EFFECT OF THE INVENTION

According to the invention, it is possible to provide composite fibers which undergo significant variation in the percentage of crimp in a reversible manner in response to humidity, due to the crimp expressed after boiling water treatment or the like, and the composite fibers can produce very comfortable fabrics with no stuffy feeling. In particular, while conventional composite fibers undergo notable reduction in percentage of crimp variation after the dyeing and finishing steps, the composite fibers of the present invention maintain their variation in percentage of crimp even after those steps, and therefore are highly practical and exhibit an effect which can result in a high level of comfort in final products such as clothing which has not been achievable in the prior art.

DETAILED DESCRIPTION OF THE INVENTION

The polyester component used to compose a moisture responsive composite fiber of the invention may be polyethylene terephthalate, polytrimethylene terephthalate, polybutylene terephthalate or the like, among which polyethylene terephthalate is preferred from the standpoint of cost and general utility.

According to the invention, the polyester component is preferably a modified polyester obtained by copolymerization with 5-sodiumsulfoisophthalic acid. If the 5-sodiumsulfoisophthalic acid is copolymerized in a very large amount, separation is prevented at the bonding interface between the polyamide component and polyester component, but it becomes difficult to achieve an excellent crimping performance. Conversely, if the copolymerization amount is very small, crystallization is promoted and it is easier to achieve excellent crimping performance, but separation at the bonding interface between the polyamide component and polyester component is promoted. Consequently, the amount of copolymerized 5-sodiumsulfoisophthalic acid is preferably 2.0-4.5 molar percent and more preferably 2.3-3.5 molar percent.

If the intrinsic viscosity of the polyester component is too low, crystallization is promoted resulting in more excellent crimping performance, but the reeling property is reduced and fluff tends to be produced, which is unfavorable in terms of industrial production and quality. Conversely, if the intrinsic viscosity is too high, crystallization is inhibited making it difficult to achieve excellent crimping performance, while the thickening effect of the 5-sodiumsulfoisophthalic acid copolymerizing component excessively increases the melt viscosity during spinning, thereby lowering the spinning property and ductility, and tending to produce fluff and yarn breakage. Thus, the intrinsic viscosity of the polyester component is preferably 0.30-0.43 and more preferably 0.35-0.41.

On the other hand, the polyamide component is not particularly restricted so long as it has an amide bond in the main chain, and as examples there may be mentioned nylon-4, nylon-6, nylon-66, nylon-46 and nylon-12, among which nylon-6 and nylon-66 are particularly preferred from the viewpoint of reeling stability and general utility. Other components may also be copolymerized with such polyamide components as bases.

Both the polyester and polyamide components described above may contain pigments such as titanium oxide and carbon black, or publicly known antioxidants, antistatic agents and light-fast agents.

The composite fibers of the invention comprise a polyester component and a polyamide component bound in a side-by-side or eccentric core-in-sheath structure. The composited form of the polyamide component and polyester component is preferably such that both components are bonded in a side-by-side fashion from the viewpoint of crimp expression. The cross-sectional shape of the composite fibers may be a circular cross-section or a non-circular cross-section, and in the case of a non-circular cross-section there may be employed, for example, a triangular or square cross-section. A hollow section may also be present in the cross-section of the composite fibers.

The proportion of the polyester component and the polyamide component in the lateral cross-section of the fiber is preferably a ratio of polyester component/polyamide component=30/70 to 70/30 and more preferably 60/40 to 40/60, based on the weight ratio of both components. When the composite fibers of the invention have an eccentric core-in-sheath structure, the core section may be either the polyester component or the polyamide component. The core section in this case is situated eccentrically in the sheath section.

According to the invention, it is important to simultaneously satisfy the conditions for the percentage of crimp DC after the composite fibers are treated in boiling water for 30 minutes under a load of $1.76\times10^{-3}$ cN/dtex, and then dry heat treated for 30 minutes at 100° C. under a load of $1.76\times10^{-3}$ cN/dtex for stabilization of the crimps and further dry heat treated for one minute at 160° C. under a load of $1.76\times10^{-3}$ cN/dtex, and for the percentage of crimp HC after the crimped composite fibers are immersed in water at 20-30° C. for 10 hours, as well as the difference between these crimp percentages ΔC. Research by the present inventors has led to the discovery that composite fibers having such crimp properties have improved air permeability after moisture absorption, and exhibit no reduction in these properties even after steps such as dyeing and finishing.

Specifically, the percentage of crimp DC must be 1.3-15.0%, preferably 2.0-10.0% and more preferably 2.5-8.0%. If the percentage of crimp DC is too small, the percentage of crimp HC after immersion in water is larger and may result in plugging of the fabric by moisture absorption when the fibers are used to produce a fabric, such that the air permeability is reduced by moisture absorption. On the other hand, while a larger percentage of crimp DC is basically favorable, it must be suitably restricted because of the limit to permanent setting of crimps by humidity. If the percentage of crimp DC is too large, the percentage of crimp HC after immersion in water will also tend to increase, thus limiting the improvement in air permeability of fabrics.

The percentage of crimp HC after immersion in water must be 0.5-10.0%, preferably 0.5-5.0% and more preferably 0.5-3.0%. The percentage of crimp HC is preferably closer to 0 from the viewpoint of variation in air permeability, but when it is reduced to below 0.5% the percentage of crimp DC must also be reduced, and if the conditions are not precisely set the fabric will tend to have increased permeability due to moisture absorption and quality control from an industrial standpoint will be greatly hampered. On the other hand, a percentage of crimp exceeding 10.0% will result in crimping even with moisture absorption, making it difficult to obtain a fabric with excellent air permeability.

Also, the difference ΔC between the percentage of crimp DC and the percentage of crimp HC represented by the equation: ΔC(%)=DC(%)−HC(%) must be 0.5-7.0%, preferably 1.0-5.5% and more preferably 1.5-5.0%. If ΔC is less than 0.5%, the variation in air permeability of the fabric from a dry state to a moisture-absorbed state will be minimal. However, although a larger ΔC is preferred, if it exceeds 7.0% the percentage of crimp DC itself will increase, resulting also in a higher percentage of crimp HC, thus making it difficult to obtain a fabric with significantly improved air permeability due to moisture absorption.

For production of composite fibers of the invention having the crimp properties described above, it is preferred to employ a modified polyester wherein the polyester component is 5-sodiumsulfoisophthalic acid having an intrinsic viscosity of 0.30-0.43 copolymerized at 2.0-4.5 mole percent based on the acid component, and this can be easily achieved by designing the fiber structure to produce a specific range for the mechanical properties of the composite fibers.

That is, the 10% elongation stress of the composite fibers is preferably 1.6-3.5 cN/dtex, more preferably 1.8-3.0 cN/dtex and even more preferably 2.0-2.8 cN/dtex. If the stress under 10% elongation is less than 1.6 cN/dtex, it becomes difficult to obtain composite fibers having firm crimping performance, the percentage of crimp DC is lowered, and the air permeability of fabrics with moisture absorption tends to be lower. On the other hand, if the stress under 10% elongation is greater than 3.5 cN/dtex the percentage of crimp DC becomes too large, which also results in a larger percentage of crimp HC after water immersion and tends to lower the air permeability of the fabric.

Also, the strength of the composite fibers is preferably 3.0-4.7 cN/dtex, more preferably 3.3-4.3 cN/dtex and even more preferably 3.4-4.0 cN/dtex. If the strength is less than 3.0 cN/dtex, an insufficient stretching effect is produced during formation of the fibers, tending to result in a lower percentage of crimp DC upon drying and reduced air permeability of the fabric due to moisture absorption. On the other hand, a strength exceeding 4.7 cN/dtex will tend to result in an excessively large percentage of crimp DC, simultaneously increasing the percentage of crimp HC after water immersion and lowering the air permeability of the fabric.

The overall size of the composite fibers of the invention is 40-200 dtex for use as an ordinary clothing material, and the single filament size may be 1-6 dtex. Entangling may also be carried out if necessary.

For production of composite fibers having a cross-sectional shape according to the invention as described in Japanese Unexamined Patent Publication No. 2000-144518, for example, there may be used a spinneret having separate discharge holes for the high-viscosity component and the low-viscosity component and a lower linear discharge speed (a larger discharge surface area) for the high-viscosity component, running a molten polyester through the high-viscosity discharge hole and a molten polyamide through the low-viscosity discharge hole, whereby they are bonded together and then cooled to solidification. Stretching of the spun yarn which has been taken up may be accomplished using either a method of stretching after wind-up, if necessary with separate stretching involving heat treatment, or a method of stretching without winding up, if necessary with direct stretching involving heat treatment. The spinning speed employed is preferably 1000-3500 m/min. Also, for stretching and heat setting by a direct stretching method with a stretching machine equipped with two rollers, for example, the first roller may be used to preheat the yarn at 50-100° C. and then the second roller used for heat setting at 145-170° C. The stretching factor between the first and second rollers is preferably 2.75-4.0. By adjusting the heat setting temperature and stretching factor (through adjustment of the second roller stretching speed, for example) as mentioned above, it is possible to adjust the tensile strength to 3.0-4.7 cN/dtex, the 10% elongation tensile stress to 1.6-3.5 cN/dtex and the breaking elongation to 15-50%. In consideration of the handleability and use as combined filament yarn as described hereunder, the boiling water shrinkage is preferably 6-18% and more preferably 6-15%.

Finishing of the fabric requires a temperature of 100° C. or higher and a binding force for setting. Specifically, moist heat at 120° C. is applied for dyeing while dry heat at 160° C. and tension are applied for setting, and therefore the crimping performance must be able to withstand these conditions. According to prior art technology, crimps become extended under the binding force at 120° C. or 160° C., such that adequate performance is no longer exhibited. It was discovered that the property of the original yarn needed to overcome this to achieve the desired performance is the ability to maintain crimping performance even after heat treatment under the applied load. First, boiling water treatment is carried out for 3 minutes under a load of $1.76\times10^{-3}$ cN/dtex. As the polyamide component has a higher shrinkage than the polyester component, crimping is generated with the polyamide component situated inwardly. During this time, the presence of moisture extends the polyamide component, as a result of moisture absorption, and reduces the crimping as time progresses. In order to prevent this, dry heat treatment is carried out for 30 minutes at 100° C. under a load of $1.76\times10^{-3}$ cN/dtex, to remove the moisture and stabilize the crimps in a dry state. Next, dry heat treatment is carried out for 1 minute at 160° C. under a load of $1.76\times10^{-3}$ cN/dtex in order to confirm maintenance of crimping even under setting at 160° C., and this confirmation of the presence of crimps even under high temperature and binding force is essential for the crimping performance. Incidentally, although NY extends within a relatively short time when immersed in water, an immersion time of 10 hours is sufficient from the viewpoint of stable equilibrium, and the temperature of the water is preferably a temperature of 20-30° C. which is below the glass transition temperature of NY (below 35° C.). Crimping performance which is maintained even under such harsh conditions can result in the desired performance even after actual fabric finishing steps. For these reasons, the composite fibers of the invention have a notably reduced stuffy feeling compared to prior art composite fibers even after such heat treatment in finishing steps, and can therefore provide highly superior fabrics in practical terms.

The composite fibers of the invention may of course be used alone, but they may also be used as a combined filament yarn in combination with other fibers.

For example, the composite fiber of the invention may be used in combined filament yarn in combination with low-shrinkage fiber having a lower boiling water shrinkage and preferably a boiling water shrinkage of less than 5% and more preferably less than 4%, preferably with the higher-shrinkage composite fiber situated as the core. Alternatively, the composite fiber of the invention may be used in a combined filament yarn in combination with high shrinkage fiber having a higher boiling water shrinkage and preferably a boiling water shrinkage of 18% or greater and more preferably 20% or greater, preferably with the lower-shrinkage composite fiber used as the sheath. Such combined filament yarn has a satisfactory bulky feel, exhibiting excellent sensation and function.

As examples of fibers with lower shrinkage than the aforementioned composite fiber there may be mentioned fibers obtained using polyester, and especially polyethylene terephthalate, for melt spinning and spin drawing to achieve low shrinkage, and specifically there are preferred fibers with a shrinkage of less than 5% obtained by relaxed heat treatment of an undrawn filament (or, "POY") wound up at a spinning speed of 2800-3500 m/min.

On the other hand, as examples of fibers with higher shrinkage than the aforementioned composite fiber there may be mentioned fibers made of polyester, and especially polyethylene terephthalate, which have high shrinkage by copolymerization with isophthalic acid or the like.

The aforementioned combined filament yarn may be produced by combined entangling of a composite fiber of the invention with a fiber having a higher shrinkage or a fiber having a lower shrinkage. No special equipment is necessary for the combined entangling treatment, and a publicly known method of entangling by air may be employed. The number of tangles in the combined filament yarn is preferably 10-80/m.

The composite fiber of the invention may, if necessary, be further subjected to false twisting for used as false twisted yarn. Preferably, the fibers in the false twisted yarn exhibit a percentage of crimp TDC of 10-30% after the false twisted yarn is treated in boiling water for 30 minutes under a load of $1.76\times10^{-3}$ cN/dtex, and then dry heat treated for 30 minutes at 100° C. under a load of $1.76\times10^{-3}$ cN/dtex for stabilization of the crimps and further dry heat treated for one minute at 160° C. under a load of $1.76\times10^{-3}$ cN/dtex, while the fibers in the false twisted yarn exhibit a percentage of crimp THC of 5-17% after the crimped false twisted yarn is immersed in water at 20-30° C. for 10 hours, and the difference in the percentage of crimps ΔTC represented by (TDC(%)−THC (%)) is 3-15%.

If the percentage of crimp TDC is less than 10%, the crimp value of the fibers in the false twisted yarn is too small, and therefore textiles with excellent bulk cannot be obtained from such false twisted yarn. On the other hand, while a percentage of crimp TDC of greater than 30% may be desirable in terms of bulk, the increase in percentage of crimp causes the crimping conditions to become similar to false twisting conditions which produce a twisting effect, and the result is separation at the interface between the polyamide component and polyester component. The percentage of crimp TDC is more preferably 15-25% and even more preferably 18-23%.

The percentage of crimp THC is preferably closer to 0 for improved air permeability, but for false twisted yarn the percentage of crimp itself must be increased to increase the bulk. If the percentage of crimp THC is controlled to less than 5%, the percentage of crimp TDC will also have to be reduced, making it impossible to obtain a textile with excellent bulk. On the other hand, if the percentage of crimp TDH is greater than 17%, it will be difficult to obtain a textile with excellent air permeability under humid conditions because crimping will remain even with moisture absorption. The percentage of crimp THC after water immersion is more preferably 6-15% and even more preferably 7-13%.

Also, the difference ΔTC between the percentage of crimp TDC and the percentage of crimp THC is preferably not less than 3% because variation in the air permeability of the textile will be reduced when the environment changes from a dry state to a moist state. ΔTC is preferably as large as possible, but if it exceeds 15% the percentage of crimp TDC itself will increase resulting in a higher percentage of crimp THC as well, and making it difficult to obtain a textile with significantly improved air permeability due to moisture absorption. ΔTC is more preferably 5-12% and even more preferably 6-11%.

In order to obtain high crimping properties for the aforementioned false twisted yarn, it is preferred to sufficiently increase the orientation for high-strength false twisted yarn. Specifically, the tensile strength of the false twisted yarn is 2.2-3.6 cN/dtex, preferably 2.4-3.4 cN/dtex and more preferably 2.5-3.2 cN/dtex. If the tensile strength is less than 2.2 cN/dtex, the stretching effect during formation of the fibers will be inadequate, resulting in a percentage of crimp (DC) of less than 10% and preventing production of a fabric with excellent bulk. On the other hand, if the tensile strength is greater than 3.6 cN/dtex, yarn breakage may become more frequent during the draw-hot treatment step or false twisting step.

The false twisted yarn described above may be produced by false twisting composite fibers spun by the method explained above. The method of false twisting is preferably a method for high-strength-type false twisted yarn, and an out-draw method is preferred wherein a filament with sufficiently increased strength by stretching is produced and then subjected to false twisting. As regards the twisting apparatus used for the false twisting, a disk-type or belt-type friction twisting apparatus will facilitate threading, but it may also be a pin-type twisting apparatus.

The number of false twists is represented by the following formula: Number of twists $(T/m)=34000/\sqrt{(Dtex\times1.11)}\times\alpha$, wherein α is preferably 0.7-1.1 and normally a value of 0.9. Also, the temperature for the false twisting will basically differ depending on the apparatus used and may be optimized from the standpoint of crimping performance and yarn breakage during the false twisting step, but for a pin-type twisting apparatus it is preferably 120-200° C., more preferably 140-180° C. and even more preferably 145-175° C., in order to allow stable production of false twisted yarn.

The composite fibers, combined filament yarn and false twisted yarn of the invention may be used for various purposes for clothing, and for example, they are particularly preferred for purposes which demand comfort, such as sportswear, inner materials, uniforms and the like.

Combinations of the composite fibers with natural fibers can exhibit additional effects, and for example, combination with urethane or polytrimethylene terephthalate may be employed to further impart stretch properties.

EXAMPLES

The present invention will now be explained in greater detail through the following examples. The following measurements were conducted for the examples.

(1) Intrinsic Viscosity of Polyamide and Polyester

The polyamide was measured at 30° C. using m-cresol as the solvent. The polyester was measured at 35° C. using ortho-chlorophenol as the solvent.

(2) Reeling Property

Good: Satisfactory reeling property with 0-1 yarn breakage during 10 hours of continuous spinning.

Fair: Somewhat poor reeling property with 2-4 yarn breakages during 10 hours of continuous spinning.

Poor: Very poor reeling property with 5 or more yarn breakages during 10 hours of continuous spinning.

(3) Interfacial Separation Between Polyamide Component nd Polyester Component

For the cross-section of the composite fiber, a 1070× color cross-section photograph was taken and the condition of interfacial separation between the polyamide component and polyester component was evaluated based on the cross-section photograph.

None: Virtually no areas of separation (0-1) at the interface.

Few: 2-10 areas of separation at the interface in the composite fiber.

Numerous: Separation at almost all areas of the interface in the composite fiber.

(4) Tensile Strength (cN/dtex), Breaking Elongation (%)

A fiber sample was allowed to stand a day and a night in a steady temperature and humidity chamber kept at 25° C., 60% humidity, and then a sample length of 100 mm was set in a Tensilon tester (by Shimadzu Laboratories Co., Ltd.) and pulled at a rate of 200 mm/min, upon which the breaking strength and elongation were measured.

(5) 10% Elongation Stress (cN/dtex)

The stress at 10% elongation was read from the stress-elongation curve obtained by measurement of the tensile strength and breaking elongation, and the value was divided by the value of the size (dtex) of the composite fiber.

(6) Percentage Crimp DC, Percentage of Crimp HC After Water Immersion and Difference ΔC Between Them A skein with a thickness of 3330 dtex was prepared from the sample composite fiber and the skein was treated for 30 minutes in boiling water under a light load of 6 g ($1.76\times10^{-3}$ cN/dtex). The skein was pulled up from the boiling water and the moisture was initially removed with filter paper, after which it was subjected to dry heating at 100° C. under a light load of 6 g ($1.76\times10^{-3}$ cN/dtex) for 30 minutes of drying to remove the moisture. The skein was then further subjected to dry heating for 1 minute at 160° C. under a light load of 6 g ($1.76\times10^{-3}$ cN/dtex).

(a) Percentage Crimp DC (%)

A measurement sample (skein) treated in the manner described above was treated for 5 minutes under a load of 6 g ($1.76\times10^{-3}$ cN/dtex), and then the skein was taken out and further subjected to a load of 600 g (606 g total: $1.76\times10^{-3}$ cN/dtex+1.76 cN/dtex) and allowed to stand for 1 minute, upon which the length of the skein L0 was determined. Next, the 600 g load was removed, a 6 g ($1.76\times10^{-3}$ cN/dtex) load was placed thereover for 1 minute, and the length L1 was determined. The percentage of crimp DC was calculated according to the following formula.

$$DC(\%)=L0-L1/L0\times100$$

(b) Percentage Crimp HC After Water Immersion (%)

Using the skein obtained after measurement of the percentage of crimp DC, treatment was carried out for 10 minutes in water (room temperature) under a load of 6 g ($1.76\times10^{-3}$ cN/dtex). The water was drained from the skein using filter paper, and then the skein was further subjected to a load of 600 g (606 g total: $1.76\times10^{-3}$ cN/dtex+1.76 cN/dtex) and allowed to stand for 1 minute, upon which the length of the skein L2 was determined. Next, the 600 g load was removed and a 6 g ($1.76\times10^{-3}$ cN/dtex) load was placed thereover for 1 minute, and the length L3 was determined. The percentage of crimp HC after water immersion was calculated according to the following formula.

$$HC(\%)=L2-L3/L2\times100$$

(c) ΔC (%)

The difference ΔC between the percentage of crimp DC and the percentage of crimp HC was determined by the following formula.

$$\Delta C(\%)=DC(\%)-HC(\%)$$

(7) Percentage Crimp TDC of Fiber in False Twisted Yarn, Percentage of Crimp THC After Water Immersion and Difference ΔTC Between Them The percentage of crimp TDC of fiber in a false twisted yarn, the percentage of crimp THC after water immersion and the difference ΔTC between them were measured in the same manner described above for the percentage of crimp TDC of the composite fibers, the percentage of crimp THC after water immersion and the difference between them ΔTC.

(8) Boiling Water Shrinkage (%)

The fiber or combined filament yarn was treated for 30 minutes in boiling water without load pressure and then lifted out of the boiling water, and after draining off the water with filter paper and allowing it to stand for one minute, the fiber length L4 before boiling water treatment and the fiber length L5 after boiling water treatment were determined under a load of $29.1\times10^{-3}$ cN/dtex. The boiling water shrinkage was determined according to the following formula.

$$\text{Boiling water shrinkage }(\%)=(L4-L5)/L4\times100$$

(9) Variation in Tube-Knit Form

The composite fibers were tube-knit and dyed with a cationic dye at boiling temperature, and then after water washing they were twist-set for one minute in a dry atmosphere at 160° C. to prepare a measuring sample. Water was dropped onto the tube-knit sample and then a side photograph of the tube-knit (200×) was taken to examine the condition of the water droplet-wetted sections and their surroundings, upon which a visual evaluation was made regarding the swelled or contracted state of the stitches due to water droplet wetting, as well as the transparency of the tube-knit.

(a) Stitch Variation

Good: Notable swelling of stitches by water droplets.

Fair: Virtually no visible change in stitches by water droplets.

Poor: Contraction of stitches by water droplets.

(b) Transparency

Good: Very high transparency of water droplet-wetted sections.

Fair: Virtually no visible change in transparency by droplet wetting.

Poor: Reduction in transparency due to water droplet wetting.

(10) False Twisting Property

After 10 hours of continuous false twisting, evaluation was made on the following 3-level scale based on the condition of yarn breakage.

Good: 0-1 yarn breaks

Fair: 2-4 yarn breaks

Poor: 5 or more yarn breaks

Example 1

Nylon-6 with an intrinsic viscosity [η] of 1.3 and modified polyethylene terephthalate copolymerized with 3.0 mole percent 5-sodiumsulfoisophthalic acid, having an intrinsic viscosity [η] of 0.39, were melted at 270° C. and 290° C., respectively, and the composite spinning spinneret described in Japanese Unexamined Patent Publication No. 2000-144518 (wherein the spinning hole is a spinning nozzle hole composed of two oval slits A and B situated essentially on the same circumference at a spacing (d), and where the area SA of the oval slit A, the slit width $A_1$, the area SB of the oval slit B, the slit width $B_1$ and the area SC defined by the inner perimeters of the oval slits A and B simultaneously satisfy the following inequalities [1] to [4]:

[1] $B_1<A_1$

[2] $1.1 \leqq SA/SB \leqq 1.8$

[3] $0.4 \leqq (SA+SB)/SC \leqq 10.0$

[4] $d/A_1 \leqq 3.0$)

was used for extrusion of the polyethylene terephthalate from slit A and the nylon-6 from slit B, at a discharge volume of 12.7 g/min each, to form a side-by-side undrawn composite filament. After cooling the undrawn filament to solidification and applying a lubricant, the filament was preheated with a first roller at a speed of 1000 m/min and a temperature of 60° C., and then subjected to drawing heat treatment between the first roller and a second roller heated to a temperature of 150° C. at a speed of 3050 m/min (drawing factor: 3.05), and wound up to obtain an 86 dtex/24 fil composite fiber. The production efficiency for the reeling process was highly satisfactory, and no yarn breaks occurred in 10 hours of continuous spinning. The evaluation results are shown in Table 1.

Examples 2-7, Comparative Examples 1-9

Composite fibers were produced in the same manner as Example 1. However, the polyester component was modified polyethylene terephthalate copolymerized with copolymerizable amounts of 5-sodiumsulfoisophthalic acid as shown in Table 1, and the intrinsic viscosities were as shown in Table 1, while the discharge volumes for the components (same for polyester component and polyamide component) and second roller speeds for the spinning were changed as shown in Table 1. The results are shown in Table 1.

TABLE 1

| | Polyester component | | Spinning | | Drawing | | Dynamic properties | |
|---|---|---|---|---|---|---|---|---|
| | Polymerization (mol %) | Intrinsic viscosity [η] | Component discharge (g/min) | Spinning property | Second roller speed (m/min) | Stretch property | Strength (cN/dtex) | Elongation (%) |
| Example 1 | 3.0 | 0.39 | 12.7 | good | 3050 | good | 3.4 | 40 |
| Comp. Ex. 1 | 2.6 | 0.48 | 11.2 | fair | 2700 | good | 2.3 | 41 |
| Comp. Ex. 2 | 2.6 | 0.48 | 12.7 | good | 3050 | poor | — | — |
| Comp. Ex. 3 | 3.0 | 0.39 | 10.4 | poor | 2500 | good | 2.4 | 63 |
| Comp. Ex. 4 | 3.0 | 0.39 | 11.7 | fair | 2800 | good | 3.0 | 52 |
| Example 2 | 3.0 | 0.39 | 11.9 | good | 2850 | good | 3.1 | 50 |
| Example 3 | 3.0 | 0.39 | 12.1 | good | 2900 | good | 3.2 | 48 |
| Example 4 | 3.0 | 0.39 | 12.5 | good | 3000 | good | 3.4 | 44 |
| Example 5 | 3.0 | 0.39 | 13.8 | good | 3300 | good | 3.7 | 33 |
| Example 6 | 3.0 | 0.39 | 14.6 | good | 3500 | good | 3.8 | 26 |
| Example 7 | 3.0 | 0.39 | 15.4 | good | 3700 | good | 4.5 | 19 |
| Comp. Ex. 5 | 3.0 | 0.39 | 15.8 | fair | 3800 | good | 4.7 | 15 |
| Comp. Ex. 6 | 3.0 | 0.39 | 16.7 | poor | 4000 | good | 5.0 | 7.4 |
| Comp. Ex. 7 | 4.6 | 0.39 | 12.7 | poor | 3050 | good | 2.2 | 37 |
| Comp. Ex. 8 | 3.0 | 0.29 | 12.7 | poor | — | — | — | — |
| Comp. Ex. 9 | 3.0 | 0.45 | 12.7 | good | 3050 | good | 3.7 | 41 |

| | Dynamic properties 10% stress (cN/dtex) | Interfacial separation | Crimp properties DC (%) | HC (%) | ΔC (%) | Variation of tube-knit form Stitch spread | Transparency |
|---|---|---|---|---|---|---|---|
| Example 1 | 2.0 | none | 3.3 | 1.6 | 1.7 | good | good |
| Comp. Ex. 1 | 1.5 | none | 1.2 | 3.9 | −2.7 | poor | poor |
| Comp. Ex. 2 | — | — | — | — | — | — | |
| Comp. Ex. 3 | 0.9 | none | 0.9 | 3.8 | −2.9 | poor | poor |
| Comp. Ex. 4 | 1.5 | none | 1.2 | 2.8 | −1.6 | poor | poor |
| Example 2 | 1.7 | none | 1.4 | 0.6 | 0.8 | good | good |
| Example 3 | 1.8 | none | 1.7 | 1.1 | 0.6 | good | good |
| Example 4 | 2.0 | none | 3.3 | 1.8 | 2.0 | good | good |
| Example 5 | 2.7 | none | 8.3 | 5.3 | 3.0 | good | good |
| Example 6 | 3.2 | none | 11.7 | 8.2 | 3.5 | good | good |
| Example 7 | 3.4 | none | 14.9 | 9.7 | 5.2 | good | good |
| Comp. Ex. 5 | 3.9 | none | 16.6 | 10.9 | 5.7 | fair | fair |
| Comp. Ex. 6 | 4.3 | none | 19.8 | 12.3 | 7.5 | fair | fair |
| Comp. Ex. 7 | 1.3 | none | 1.3 | 3.7 | −2.7 | poor | poor |
| Comp. Ex. 8 | — | — | — | — | — | — | — |
| Comp. Ex. 9 | 2.2 | none | 1.0 | 2.5 | −1.5 | poor | poor |

Example 8

Polyethylene terephthalate having an intrinsic viscosity of 0.64 and containing 0.3% titanium dioxide as a delustering agent was melted at 290° C., extruded at a discharge volume of 25 g/min, cooled to solidification and lubricated, and then wound up at a speed of 3000 m/min to obtain an undrawn filament. The undrawn filament was subjected to relaxation heat treatment with a stretching machine equipped with a non-contact heater, at a speed of 500 m/min, a draw factor of 0.98, a draw temperature of 130° C. and a setting temperature of 230° C., to obtain an 84 dtex/24 fil fiber.

Then, using the composite fiber obtained in Example 1 as the high-shrinkage fiber component and the fiber obtained above as the low-shrinkage fiber component, the two fibers were doubled and subjected to air entangling and wound up to obtain 168 dtex/48 fil combined filament yarn. The evaluation results are shown in Table 2.

Comparative Example 10

A combined filament yarn was obtained in the same manner as Example 8. However, the low-shrinkage fiber component used was the composite fiber of Comparative Example 1. The evaluation results are shown in Table 2.

TABLE 2

| | High-shrinkage fiber Fiber (Boiling water shrinkage %) | Low-shrinkage fiber properties Strength (cN/dtex) | Elongation (%) | Boiling water shrinkage (%) | Combined filament yarn properties Strength (cN/dtex) | Elongation (%) | Boiling water shrinkage (%) | Number of tangles (/m) | Variation of tube-knit form Stitch spread | Trans-parency |
|---|---|---|---|---|---|---|---|---|---|---|
| Example 8 | Example 1 (15.0%) | 2.0 | 145 | 3.5 | 2.7 | 41 | 15.2 | 45 | good | good |
| Comp. Ex. 10 | Comp. Ex. 1 (18.2%) | 2.0 | 145 | 3.5 | 2.2 | 41 | 17.8 | 42 | poor | poor |

Example 9

Polyethylene terephthalate having an intrinsic viscosity of 0.64, copolymerized with 10 mole percent isophthalic acid and containing 0.3% titanium dioxide as a delustering agent was melted at 285° C., extruded at a discharge volume of 25 g/min, cooled to solidification and lubricated, and then wound up at a speed of 1200 m/min to obtain a 100 dtex/12 fil undrawn filament. The undrawn filament was stretched with a stretching machine equipped with a non-contact heater, at a speed of 500 m/min, a draw factor of 3.0 and a draw temperature of 80° C., to obtain an 33 dtex/12 fil fiber.

Then, using the composite fiber obtained in Example 1 as the low-shrinkage fiber component and the fiber obtained above as the high-shrinkage fiber component, the two fibers were doubled and subjected to air entangling and wound up to obtain 117 dtex/36 fil combined filament yarn. The evaluation results are shown in Table 3.

Comparative Example 11

A combined filament yarn was obtained in the same manner as Example 9. However, the low-shrinkage fiber component used was the composite fiber of Comparative Example 1. The evaluation results are shown in Table 3.

TABLE 3

| | High-shrinkage fiber properties Strength (cN/dtex) | Elongation (%) | Boiling water shrinkage (%) | Low-shrinkage fiber Fiber (Boiling water shrinkage (%)) | Combined filament yarn properties Strength (cN/dtex) | Elongation (%) | Boiling water shrinkage (%) | Number of tangles (/m) | Variation of tube-knit form Stitch spread | Trans-parency |
|---|---|---|---|---|---|---|---|---|---|---|
| Example 9 | 4.3 | 27 | 39.5 | Example 1 (15.0%) | 3.3 | 32 | 33.7 | 43 | good | good |
| Comp. Ex. 11 | 4.3 | 27 | 39.5 | Comp. Ex. 1 (18.2%) | 2.2 | 31 | 34.5 | 45 | poor | poor |

Example 10

Using the composite fiber obtained in Example 1 as the starting thread, a pin-type false twisting machine was used for false twisting at a twisting speed of 80 m/min, a twist factor of 0.99, 3355 twists, a twist coefficient α of 0.9 and a heater temperature of 160° C., to obtain an 84 dtex/24 fil false twisted yarn. The results are shown in Table 4.

Comparative Example 12

A combined filament yarn was obtained in the same manner as Example 10. However, the starting thread used was the composite fiber of Comparative Example 1. The evaluation results are shown in Table 4.

TABLE 4

| | | | | Dynamic properties | | Crimp properties | | | Variation of tube-knit form | |
|---|---|---|---|---|---|---|---|---|---|---|
| | Starting thread | Process-ability | Interfacial separation | Strength (cN/dtex) | Elongation (%) | TDC (%) | THC (%) | ΔTC (%) | Stitch spread | Trans-parency |
| Example 10 | Example 1 | good | none | 3.2 | 26 | 18.8 | 9.6 | 9.2 | good | good |
| Comp. Ex. 12 | Example 1 | poor | none | 1.9 | 26 | 8.5 | 5.3 | 3.2 | poor | good |

INDUSTRIAL APPLICABILITY

According to the present invention, it is possible to provide a composite fiber, which expresses crimping upon boiling water treatment, wherein humidity produces reversible variation in the percentage of crimp. The composite fibers of the invention can yield highly comfortable fabrics with no stuffy feeling. Notably, while conventional composite fibers have considerably reduced variation in percentage of crimp after the processes of dyeing and finishing, the composite fiber of the invention maintains high percentage of crimp variation properties even after such processes and is highly practical, exhibiting a high level of comfort in final products such as clothing which has not been achieved in the prior art and, therefore, its industrial value is very high.

We claim:

1. A composite fiber comprising a polyester component and a polyamide component bound in a side-by-side or eccentric core-in-sheath structure, in which the polyester component is a modified polyester having an intrinsic viscosity (IV) of 0.30-0.43 and comprising 5-sodiumsulfoisophthalic acid copolymerized in an amount of 2.0-4.5 molar % based on the acid component, and which composite fiber exhibits a percentage of crimp DC of 1.3-15.0% after the composite fiber is treated in boiling water for 30 minutes under a load of $1.76\times10^{-3}$ cN/dtex, and then dry heat treated for 30 minutes at 100° C. under a load of $1.76\times10^{-3}$ cN/dtex for stabilization of the crimps and further dry heat treated for one minute at 160° C. under a load of $1.76\times10^{-3}$ cN/dtex, a percentage of crimp HC of 0.5-10% after the crimped composite fiber is immersed in water at 20-30° C. for 10 hours, and a difference ΔC between the percentages of crimp DC and HC of 0.5-7.0%, as defined represented by the following equation:

$$\Delta C(\%)=DC(\%)-HC(\%).$$

2. A composite fiber according to claim 1, wherein the tensile stress under 10% elongation of the composite fiber is 1.6-3.5 cN/dtex.

3. A composite fiber according to claim 1, wherein the tensile strength is a tensile strength of 3.0-4.7 cN/dtex.

4. A combined filament yarn comprising a composite fiber according to claim 1 and a different type of fiber with a smaller boiling water shrinkage.

5. A combined filament yarn comprising a composite fiber according to claim 1 and a different type of fiber with a larger boiling water shrinkage.

6. A false twisted yarn obtained by supplying a composite fibers comprising a polyester component and a polyamide component bound in a side-by-side or eccentric core-in-sheath structure to a false twisting step, (1) wherein the polyester component is a modified polyester having an intrinsic viscosity (IV) of 0.30-0.43 and comprising 5-sodiumsulfoisophthalic acid copolymerized in an amount of 2.0-4.5 molar % based on the acid component, and (2) the composite fibers in the false twisted yarn exhibit, after the false twisted yarn is treated in boiling water for 30 minutes under a load of $1.76\times10^{-3}$ cN/dtex, and then dry heat treated for 30 minutes at 100° C. under a load of $1.76\times10^{-3}$ cN/dtex for stabilization of the crimps and further dry heat treated for one minute at 160° C. under a load of $1.76\times10^{-3}$ cN/dtex, a percentage of crimp TDC of 10-30%, the fibers in the resultant crimped false twisted yarn exhibit, after the crimped false twisted yarn is immersed in water at 20-30° C. for 10 hours, a percentage of crimp THC of 5-17%, and the difference in percentage of crimp ΔTC represented by (TDC(%)−THC(%)) is 3-15%.

7. A false twisted yarn according to claim 6, wherein the composite fiber supplied to the false twisting step exhibits, after the composite fibers are treated in boiling water for 30 minutes under a load of $1.76\times10^{-3}$ cN/dtex, and then dry heat treated for 30 minutes at 100° C. under a load of $1.76\times10^{-3}$ cN/dtex for stabilization of the crimps and further dry heat treated for one minute at 160° C. under a load of $1.76\times10^{-3}$ cN/dtex, a percentage of crimp DC of 1.3-15.0%, and, after the crimped composite fibers are immersed in water at 20-30° C. for 10hours, a percentage of crimp HC of 0.5-10%, and a difference ΔC between the percentage of crimps DC and HC of 0.5-7.0%.

8. A composite fiber according to claim 1, wherein the tensile stress under 10% elongation of the composite fiber is 1.6-3.5 cN/dtex.

9. A composite fiber according to claim 1, wherein the tensile strength is a tensile strength of 3.0-4.7 cN/dtex.

10. A composite fiber according to claim 2, wherein the tensile strength is a tensile strength of 3.0-4.7 cN/dtex.

* * * * *